US005113537A

United States Patent [19]

Turk

[11] Patent Number: 5,113,537

[45] Date of Patent: May 19, 1992

[54] PORTABLE SLEEPING UNIT FOR CHILDREN

[76] Inventor: Sandra L. Turk, 2442 Jackson SE., Albany, Oreg. 97321

[21] Appl. No.: 631,897

[22] Filed: Dec. 21, 1990

[51] Int. Cl.[5] ..... A45F 3/22

[52] U.S. Cl. ..... 5/121; 5/123; 5/127; 5/101; 135/90

[58] Field of Search ..... 5/120, 121, 122, 123, 5/127, 130, 236.1, 237, 101; 135/90

[56] References Cited

U.S. PATENT DOCUMENTS

| | | | |
|---|---|---|---|
| 692,501 | 2/1902 | Bentley . | |
| 1,087,806 | 2/1914 | Miller . | |
| 1,363,667 | 12/1920 | Mahr . | |
| 1,401,846 | 12/1921 | Wiles | 5/121 |
| 1,431,408 | 10/1922 | Melniker et al. . | |
| 1,480,591 | 1/1924 | Bakesef et al. . | |
| 2,220,330 | 11/1940 | Hilger | 5/120 |
| 2,638,606 | 5/1953 | Austin | 5/236.1 |
| 2,667,648 | 2/1954 | Donovan | 5/97 |
| 2,694,208 | 11/1954 | Christensen | 5/122 |
| 2,781,528 | 2/1957 | Lo Vico | 5/122 |
| 2,927,331 | 3/1960 | Ruiz | 5/362 |
| 3,837,019 | 9/1974 | Hoff | 5/120 |
| 4,021,868 | 5/1977 | Fueslein | 5/123 |
| 4,686,720 | 8/1987 | Newell | 5/121 |
| 4,691,394 | 9/1987 | Woo | 5/120 |
| 4,862,534 | 9/1989 | Gomez-Marcial | 5/414 |

FOREIGN PATENT DOCUMENTS

| | | | |
|---|---|---|---|
| 72199 | 2/1951 | Denmark | 5/122 |
| 2546693 | 6/1977 | Fed. Rep. of Germany | 5/127 |

*Primary Examiner*—Renee S. Luebke
*Assistant Examiner*—Flemming Saether
*Attorney, Agent, or Firm*—Kimmel, Crowell & Weaver

[57] ABSTRACT

A portable sleeping unit for children includes a collapsible frame and a hammock supported thereby. The hammock comprises plural fabric panels sewn together along their edges, with a stay embedded in each seam, and a slide fastener for interconnecting the two topmost panels to close the unit. The hammock is loosely suspended from the frame by straps extending from either end, so that when a child is placed inside the hammock, its weight bows the lower stays doenward, and the remaining stays bow generally outward to tension the hammock panels and produce a generally football-shaped enclosure.

11 Claims, 3 Drawing Sheets

PORTABLE SLEEPING UNIT FOR CHILDREN

BACKGROUND OF THE INVENTION

1. Field of the Invention

This invention relates to baby hammocks.

2. Description of the Prior Art

Furniture designers and inventors have provided a great variety of devices for supporting and confining a baby or toddler which is, or should be, sleeping. One such device, disclosed in U.S. Pat. No. 2,220,330, includes a rigid, generally cylindrical frame, which supports a fabric sleeping chamber spaced inwardly from the framing. The structure may be provided with hooks at its ends, so that it can be used as a hammock. The fabric of the sleeping chamber not only supports the child, but also protects it from animals and insects.

Other baby hammocks are shown in U.S. Pat. Nos. 1,480,591 and 1,431,408. Other patents of interest include U.S. Pat. Nos. 1,363,667, 692,501, 1,087,806, 2,667,648, 4,862,534 and 2,927,331, the latter five of which show various insect netting arrangements.

There are many collapsible sleeping units for children, including those shown in the aforementioned U.S. Pat. Nos. 1,480,591 and 1,431,408. The prior devices, however, tend to be too large or cumbersome for easy transport and use, particularly for camping and other outdoor recreational activities.

SUMMARY OF THE INVENTION

It is therefore an object of the invention to provide a collapsible baby hammock which can be easily set up, and which knocks down to a very small, lightweight, and easy-to-carry package.

Another object is to provide a hammock which will safely and securely hold a small child, and to protect the child from insects, wind, sun and sand.

These and other objects are realized in a portable sleeping unit for children which includes a frame and a hammock supported thereby. The frame comprises a pair of A-frame members whose feet are pivotally connected to opposite ends of a pair of parallel, ground engaging rails. Each A-frame includes a pair of members hinged together at their upper end, and normally spread apart by a cross-brace which can be collapsed to allow the members of the A-frame to fold together. The A-frame members can rotate about 250° from a stowed position adjacent the rails to a deployed position nearly vertical thereto.

The hammock itself comprises plural fabric panels sewn together along their edges. A fiberglass pole or stay is embedded in the fabric at each seam, and a slide fastener or other means are provided for interconnecting the two topmost panel seams to close the unit. The hammock is loosely suspended from the frame by straps extending from either end, so that when a child is placed inside the hammock, its weight bows the lower stays downward, the remaining stays bowing generally outward to tension the hammock panels and produce a generally football-shaped enclosure.

BRIEF DESCRIPTION OF THE DRAWINGS

In the accompanying drawings.

DESCRIPTION OF THE PREFERRED EMBODIMENT

Figure 1:
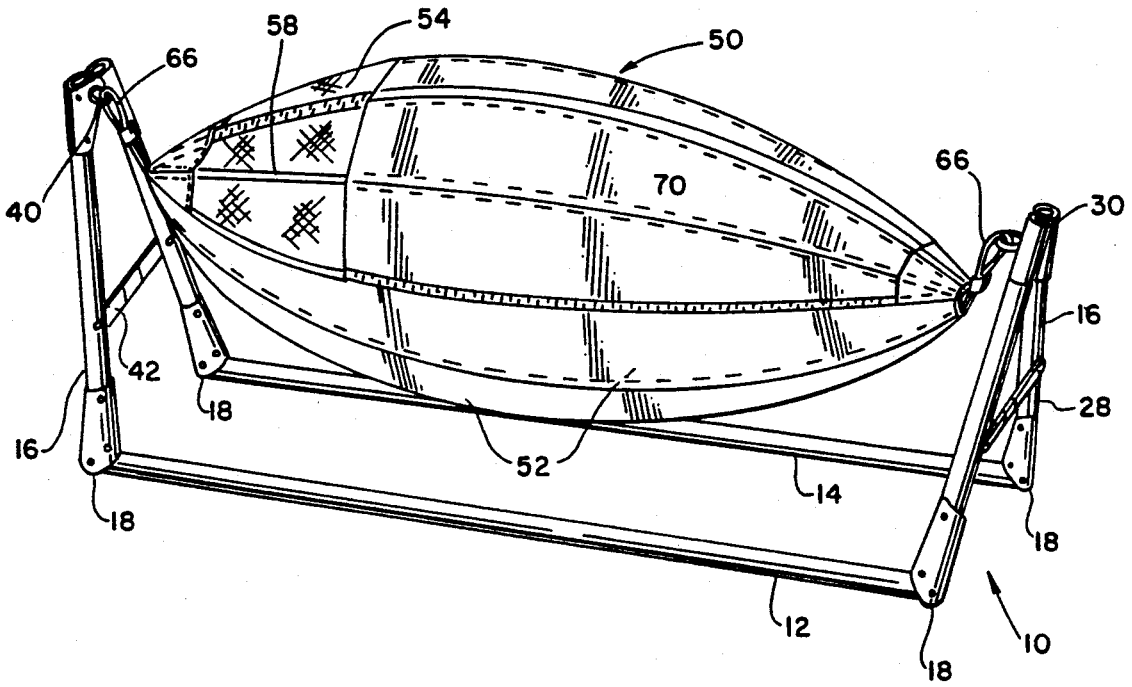
FIG. 1 is a perspective view of a sleeping unit embodying the invention.
Figure 2:
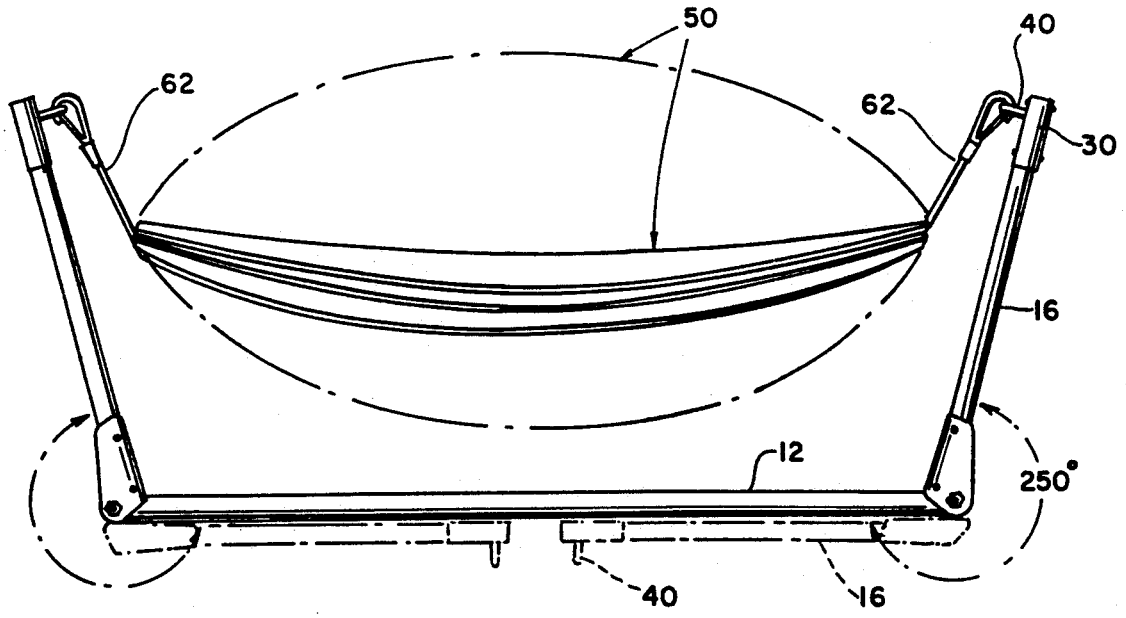
FIG. 2 is a side elevation thereof.

Referring to FIGS. 1 and 2, the invention is embodied in a collapsible sleeping unit comprising a frame 10, which supports a hammock designated generally by reference numeral 50.

The frame 10 includes a pair of parallel ground rails 12,14 whose ends are interconnected by respective A-frame members 16 attached thereto by hinges 18.

Figure 3:
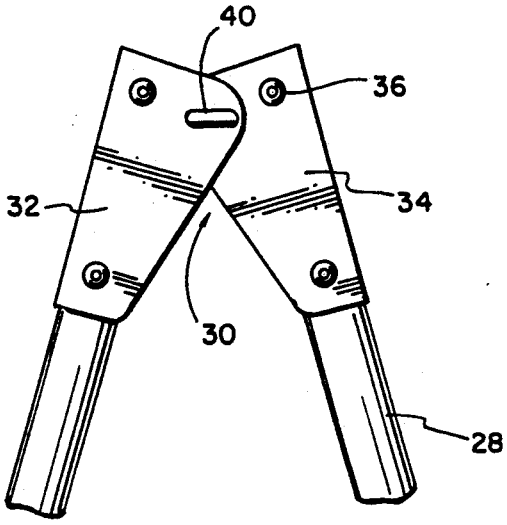
FIG. 3 is an end view of an upper portion of the supporting frame of the invention.
Figure 4:
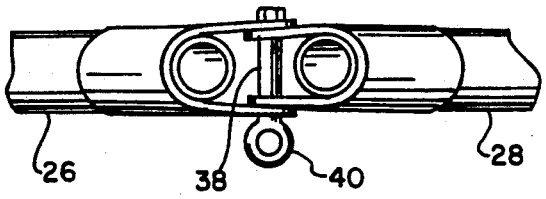
FIG. 4 is a top view of the structure shown in FIG. 3.

Each A-frame is constructed from a pair of tubes 26,28 interconnected at their upper ends by a hinge 30, best seen in FIGS. 3 and 4. The tubing is preferably anodized aluminum alloy (3003-H14) tubing having a 0.75 inch outside diameter, and a 0.49 inch inside diameter. The hinge comprises a pair of U-plates 32,34, each plate being connected by bolts or rivets 36 to the upper end of a respective tube. The plates of each hinge are interconnected by a bolt 38 passing through aligned holes in the respective plates, and each bolt has an eye 40 at its outer end for supporting the hammock, as described further below. An articulated cross-brace 42 (FIG. 1) keeps the legs spread apart in use.

Figure 5:
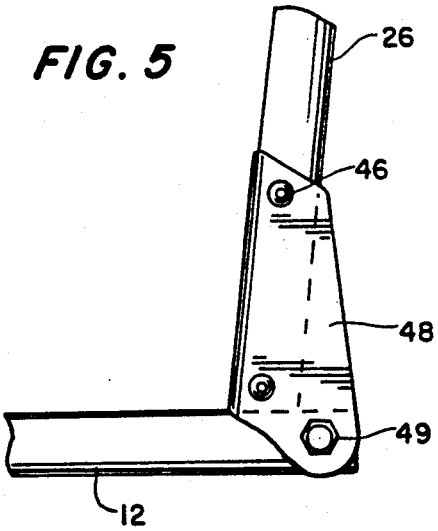
FIG. 5 is a side elevation of a lower portion of the frame.

The four hinges 18 described above are identical, each comprising a sheet metal member 44 (FIG. 5) having a "U" cross-section, attached to the tubes 26,28 by rivets 46. The open arms 48 of the "U" have aligned holes therein which receive bolts 49 that extend also through corresponding holes in the ends of the rails. As shown in FIG. 2, the configuration and orientation of the hinges permits the A-frame members to be folded flat against the rails for storage, but limits deployment of the A-frame members to about 250° (i.e., 20° shy of vertical) by interference between the hinges and the sides of the rails.

The hammock 50 itself includes a plurality of (e.g., eight) almond-shaped (or "lenticular") pieces 52,54 of fabric laterally joined to neighboring pieces by seams 56. The drawings show the hammock constructed of two types of material, as this is presently preferred. Reference numeral 52 designates panels made of a water resistant material such as pack cloth, while numeral 54 designates panels made of an insect netting such as netting known as "no-seeum", which has a very fine mesh. Each seam comprises a pair of parallel stitch lines with a space therebetween. A slender pole or stay 58, preferably made of fiberglass for light weight, strength and corrosion avoidance, is inserted between the overlapping fabric layers, into the space between the stitching lines. The seams are closed at each end by sewing them to a common grommet 60, to retain the stays lengthwise.

The uppermost two panels are not sewn together; rather, each has a hemmed edge containing its own stay. A slide fastener strip 61 is sewn to each of the opposing hemmed edges, so that the hammock can be opened and closed.

Figure 6:
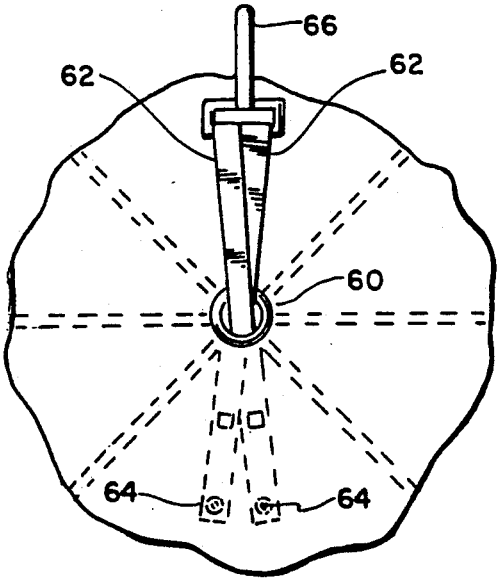
FIG. 6 is an end view of the hammock portion of the invention.

The hammock is supported at each end 60 by a fabric strap 62 whose free ends extends into the hammock through its end grommets and are rivetted, stapled, or otherwise permanently secured to the two lowermost adjacent panels at 64, as shown in FIG. 6. Each strap extends through one end of a safety clip 66, for engaging the respective frame eye 40.

Figure 8:
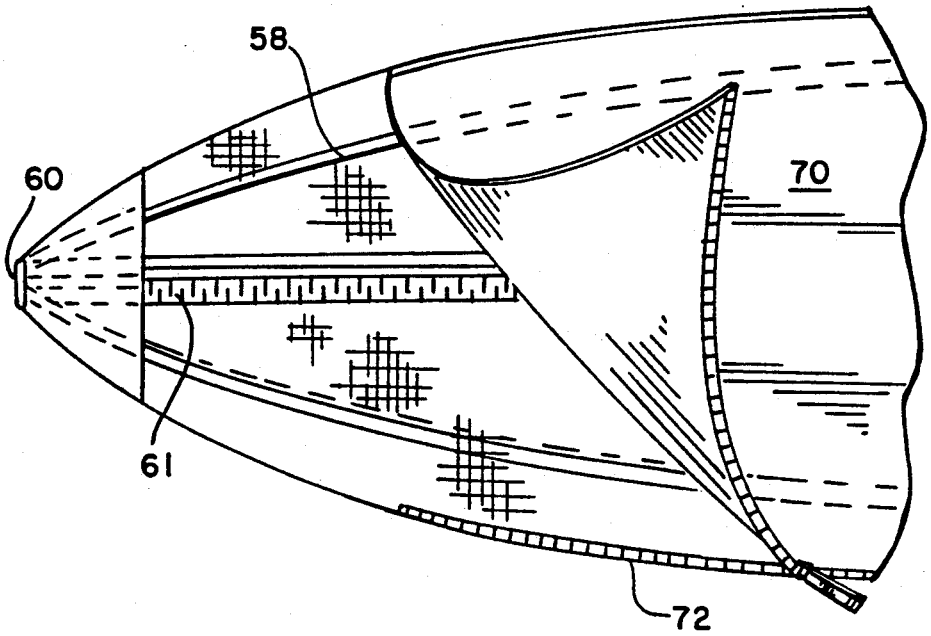
FIGS. 8 and 9 are, respectively, side and end elevations of the hammock, expanded by the weight of a child inside the hammock.
Figure 9:
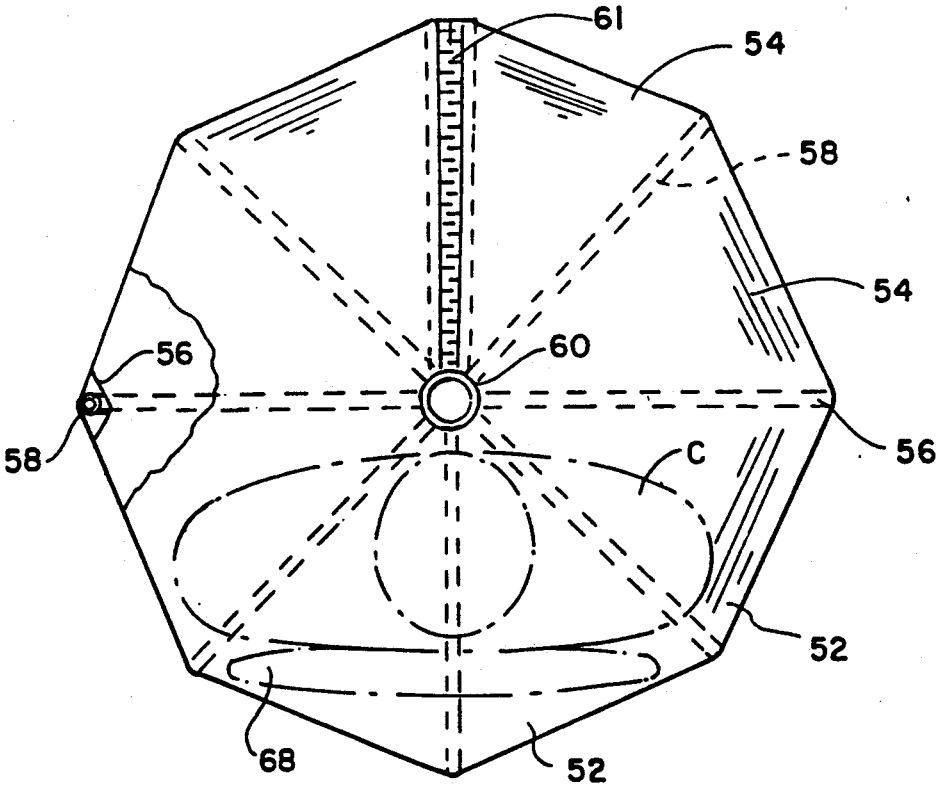

The preferred embodiment of the invention also includes a lightweight, removable foam mattress 68 (FIG. 9) for insertion into the hammock, and a weather-resistant three-quarter cover 70. The latter may be connected to the hammock by means of slide fasteners 72 or functionally equivalent fasteners, as illustrated in FIGS. 1 and 8. A carrying bag 74 may also be provided as an accessory for the invention.

The spacing between the eyes at the tops of the opposite A-frames is not substantially greater than the length of the hammock; therefore, the hammock is not tensioned by the frame. In fact, the hammock is initially limp and shapeless, as shown in FIG. 2. However, when a child (designated by reference letter C in FIG. 9) is placed in the hammock on the mattress, his or her weight causes the lower stays to bow downward and outward, thus shortening the length of the hammock. Now, since the ends of the stays are effectively joined at the ends of the hammock by the grommets, the remaining stays must bow a corresponding amount. As a result, the stays all press radially outward, tightening the hammock fabric, and giving it the shape of a football. The design of the hammock, and this alone, maximizes the volume of the hammock, giving it an inflated look, while the child remains in the hammock.

Figure 7:
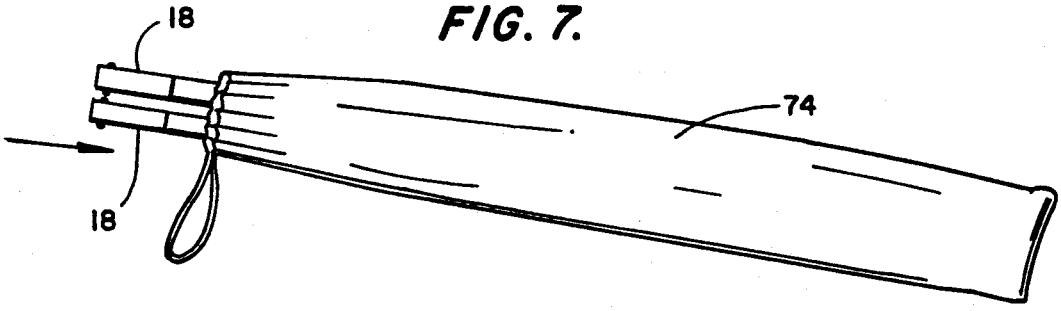
FIG. 7 is a side elevation of the hammock, collapsed.

Upon opening the slide fastener, the child may be removed from the hammock, which then tends to assume its original collapsed state, shown in solid lines in FIG. 2. Once the hammock is removed from the frame eyes, the frame can be folded, first by collapsing the individual A-frames, and then by rotating the A-frame members downward and under the rails, to the position shown in FIG. 2. The resulting compactly folded frame, when wrapped in the collapsed hammock, may then be placed in a carrying bag for transport, as shown in FIG. 7. The above procedure is reversed to re-erect the hammock.

Inasmuch as the invention is subject to modifications and variations, it is intended that the foregoing description and the accompanying drawings shall be interpreted as illustrative of only one form of the invention, whose scope is to be measured by the following claims.

I claim:

1. A portable sleeping unit for children comprising a hammock comprising a plurality of lenticular fabric panels laterally interconnected by seams so as to form a substantially closed surface, a plurality of stays extending generally along said seams, means for interconnecting the ends of the stays at either end of the hammock, and at least one strap connected to the fabric at either end of the hammock, and a collapsible frame including spaced uprights having means for suspending the hammock, whereby, when the hammock is suspended from said uprights and a child is placed in the hammock, the stays are bowed outward by the weight of the child, expanding the hammock.

2. The invention of claim 1, wherein the stays are fiberglass poles.

3. The invention of claim 1, wherein at least some of said panels are formed of insect netting.

4. The invention of claim 1, wherein at least some of said panels are formed of a waterproof material.

5. The invention of claim 1, wherein said frame comprises a pair of parallel rails interconnected at opposite ends by respective A-frame members, each of said A-frame members comprising a pair of hinged tubes and a cross-brace.

6. The invention of claim 5, wherein each of said cross-braces is collapsible.

7. The invention of claim 5, wherein each of said A-frames is pivotally connected to both of said rails, so that the frame can be collapsed.

8. The invention of claim 7, wherein each of said A-frames has a hinge connection to said rails, said hinges being constructed to permit the A-frame to move between a collapsed position flat against said rails, and a deployed position approximately 250° from said collapsed position.

9. The invention of claim 1, further comprising a weather-resistant cover sized to fit over an upper portion of the hammock, and releasable fasteners connected along at least two edges of the cover for connecting the cover over the hammock.

10. The invention of claim 1, wherein said means for interconnecting the ends of the stays is a pair of grommets, each grommet being joined to all of said fabric panels at either end of the hammock.

11. The invention of claim 10, wherein each of said seams comprises two lines of stitching, a stay is retained in the space between said stitching lines, and said grommets close the ends of said means.

* * * * *